US007830351B2

(12) United States Patent
Wang et al.

(10) Patent No.: US 7,830,351 B2
(45) Date of Patent: Nov. 9, 2010

(54) LCD GATE DRIVER CIRCUITRY HAVING ADJUSTABLE CURRENT DRIVING CAPACITY

(75) Inventors: Chih-Sung Wang, Jhubei (TW); Chih-Hsiang Yang, Yangmei Township (TW); Yu-Min Hsu, Beidou Township (TW); Sheng-Kai Hsu, Changhua (TW)

(73) Assignee: Au Optronics Corporation, Hsinchu (TW)

( * ) Notice: Subject to any disclaimer, the term of this patent is extended or adjusted under 35 U.S.C. 154(b) by 890 days.

(21) Appl. No.: 11/248,911

(22) Filed: Oct. 11, 2005

(65) Prior Publication Data

US 2007/0080921 A1 Apr. 12, 2007

(51) Int. Cl.
*G09G 3/36* (2006.01)

(52) U.S. Cl. ..... 345/100

(58) Field of Classification Search ..... 345/87–104
See application file for complete search history.

(56) References Cited

U.S. PATENT DOCUMENTS

| | | | | |
|---|---|---|---|---|
| 6,426,744 | B2 | 7/2002 | Hashimoto et al. | 345/214 |
| 6,753,880 | B2 * | 6/2004 | Kudo et al. | 345/690 |
| 6,850,232 | B2 | 2/2005 | Tazuke | 345/204 |
| 2002/0100921 | A1 * | 8/2002 | Mabuchi et al. | 257/222 |
| 2004/0056833 | A1 * | 3/2004 | Kitagawa et al. | 345/92 |
| 2004/0263235 | A1 | 12/2004 | Oguri | 327/334 |

FOREIGN PATENT DOCUMENTS

| | | |
|---|---|---|
| JP | 10-010497 | 1/1998 |
| JP | 10-301539 | 11/1998 |
| JP | 2000-105580 | 4/2000 |
| JP | 2004-117742 | 4/2004 |

* cited by examiner

*Primary Examiner*—Chanh Nguyen
*Assistant Examiner*—Allison Walthall
(74) *Attorney, Agent, or Firm*—Ware, Fressola Van Der Sluys & Adolphson, LLP

(57) ABSTRACT

An LCD gate driver circuitry having a control circuit to adjust the driving current according to a bias control signal, wherein the control circuit comprises a plurality of PMOS switching elements connected in parallel and a plurality of NMOS switching elements connected in parallel. These switching elements form a plurality of PMOS/NMOS switching element pairs. Each of the pairs serves as a current booster stage in the gate driver circuitry. The "ON"/"OFF" state of each switching element pair is controlled by a separate bias signal so that the switching element pairs can be selectively turned on in order to adjust the driver current as needed. As such, the same gate driver circuitry can be used with different LCD panels.

20 Claims, 11 Drawing Sheets

LCD GATE DRIVER CIRCUITRY HAVING ADJUSTABLE CURRENT DRIVING CAPACITY

FIELD OF THE INVENTION

The present invention relates generally to an LCD gate driver and, more particularly, to an LCD gate driver circuitry having an adjustable current driving capacity for use with different display panels.

BACKGROUND OF THE INVENTION

A typical prior art liquid crystal display (LCD) panel is shown in FIG. 1. As shown, the LCD panel 10 comprises a display module 20 having a plurality of pixels 22 arranged in a two-dimensional array. These pixels are controlled and activated by a plurality of data lines D1, D2, . . . , Dn and a plurality of gate lines G1, G2, . . . , Gm. The data signal in each of the data lines is provided by a data driver integrated circuit (IC) 30 and the gate signal in each of the gate lines is provided by a gate driver IC 40. The construction and operation of the prior art display panel is well understood in the art.

Typically in the prior art as illustrated in FIGS. 2 and 3, each of the pixels 22 is associated with a number of capacitors including, for example, the capacitor Clc associated with and formed by the capacitance of the liquid crystal layer located between the upper and lower electrodes, an additional charge storage capacitor Cst which maintains the voltage Vpixel after the gate line signal Gate m has passed, and the capacitance Cgs associated with the gate terminal and the source terminal of the switching element (TFT). The total capacitance associated with a pixel in an LCD may vary due to the pixel size, the thickness of the liquid crystal layer, the size of the storage capacitor, and other variables known to those skilled in the art. In FIG. 2, both Clc and Cst are connected to a common voltage Vcom. In FIG. 3, Cst is connected to a gate line.

A prior art gate driver circuit in a gate driver IC generally designated 50 and as illustrated in FIG. 4, is commonly used to provide gate line signals for driving a row of the LCD pixels. The gate driver circuit 50 typically operates rail-to-rail between Vgh and Vgl voltage potentials and has a gate input 52 and an output 54 to drive the gate of the LCD pixel switching element (TFT). The gate driver circuit 50 is made up of a PMOS switching element 56 and an NMOS switching element 58 constructed in complementary form on a silicon wafer in a well known configuration. The gate driver circuit 50 operates in a well known manner. When the signal at the input 52 is high, it causes the PMOS switching element 56 to conduct due to the formation of a P-channel while the NMOS switching element 58 remains "OFF" or non-conducting. In this state, the voltage level at the output 54 is high and the equivalent circuit of the gate driver circuit 50 is as shown in FIG. 5A. When the signal at the input 52 is low, it causes the NMOS switching element 58 to conduct due to the formation of a N-channel while the PMOS switching element 56 is "OFF" or non-conducting. In this state, the voltage level at the output 54 is low and equivalent circuit is as shown in FIG. 5B. Rm1 and Rm2 are the internal impedance of M1 and the internal impedance of M2, respectively.

Now as the load presented to the gate driver output varies with the number of pixels along the same gate line and the impedance of the individual pixels, it can be seen that there will be longer charge time required for the capacitors because there is less current available to charge the capacitors in a given time interval.

Ideally, it would be desirable to increase the driving capacity of the gate driver in order to reduce the gate delay time when the load increases. Furthermore, it would be desirable not to have a gate driver with excessive driving capacity when the load is not heavy such as when the gate driver is used to drive a small the LCD panel.

In a display panel with high resolution and a high frame rate, it is important to charge the pixel capacitance within a certain time. However, as seen from the prior art described above, the driving load capacity of a conventional prior art gate driver IC is fixed. When the conventional prior art gate driver IC is used in a different display panel for example as shown in FIG. 12A, the difference in the load on a gate line may affect the viewing quality of the display panel because the pixel capacitance takes longer to charge as shown by the charging waveform in FIG. 12B. In FIG. 12A, Y1-Y4 are separate gate driver ICs 40, each of which is used to drive a number of gate lines in a TFT-LCD panel 20, and the input control signal is provided to the gate driver ICs 40 so that the gate lines in the LCD panel are scanned in a sequential order, for example.

If we can widen the adjustment range of the driving capacity of a gate driver IC, the same IC can be used in display panels of different sizes or in the display panels of different designs. As such, it would not be necessary to produce different gate driver IC's in order to meet the driving need of different display panels.

Accordingly, it is an object of the present invention to provide an LCD gate driver circuitry having an adjustable current driving capacity for use with different display panels.

SUMMARY OF THE INVENTION

An LCD gate driver circuitry has a control circuit to adjust the driving current according to a bias control signal. The control circuit comprises a plurality of PMOS switching elements connected in parallel and a plurality of NMOS switching elements connected in parallel. These switching elements form a plurality of PMOS/NMOS switching element pairs. Each of the pairs serves as a current booster stage in the gate driver circuitry. The "ON"/"OFF" state of each switching element pair is controlled by a separate bias signal so that the switching element pairs can be selectively turned on in order to adjust the driver current as needed. As such, the same gate driver circuitry can be used with different LCD panels. When an LCD panel requires a plurality of gate drivers to drive a large number of gate lines, a control module is used to provide an input signal to the gate drivers so that the gate lines in the LCD panel are scanned in a sequential manner. The control module can also be used to provide the bias control signal to all gate drivers in order to adjust the driving current of these gate drivers.

DETAILED DESCRIPTION OF INVENTION

Figure 1:
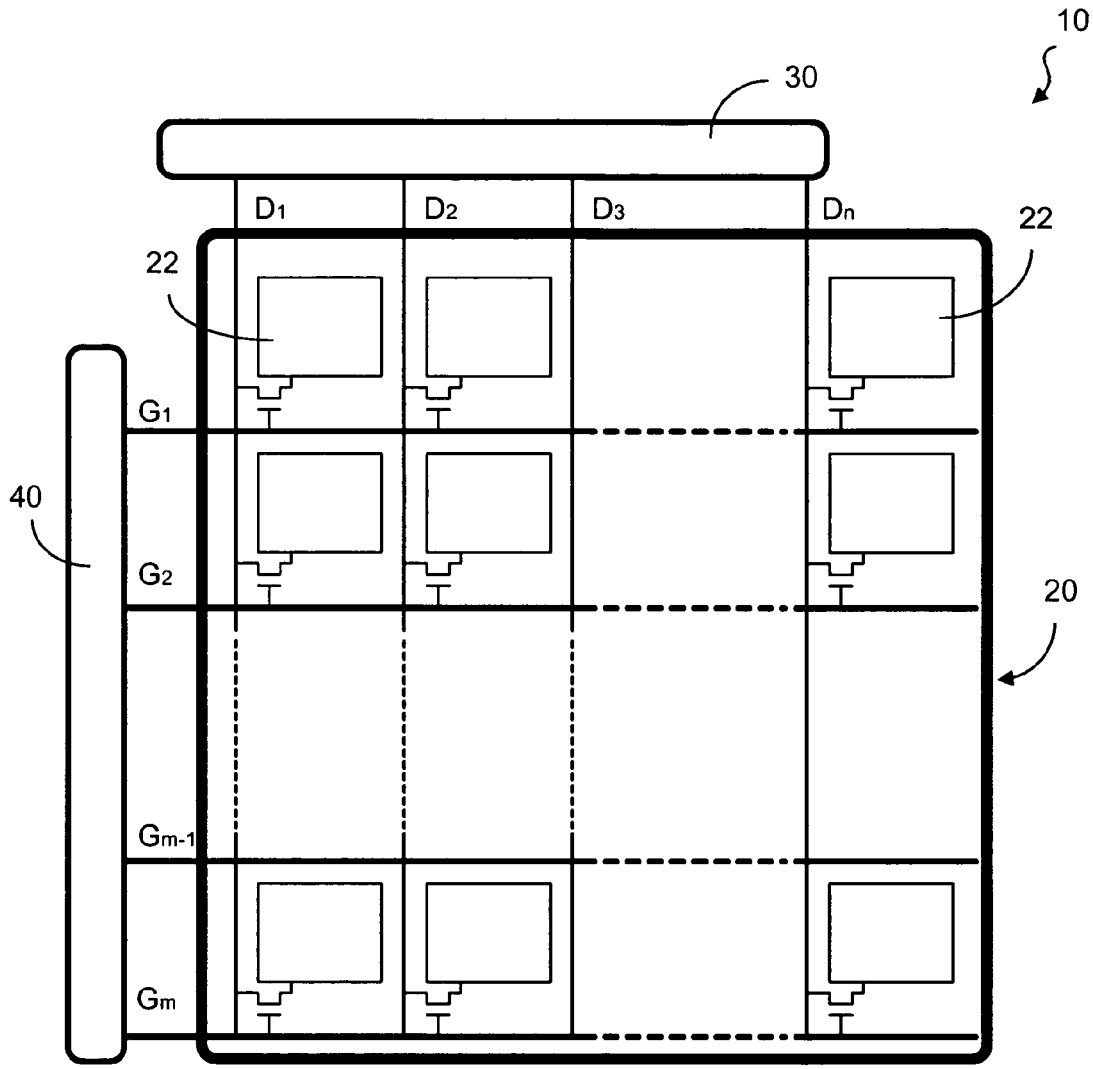
FIG. 1 (prior art)
FIG. 1 is a schematic representation of a typical prior LCD display panel formed by an array of LCD pixels.
Figure 2:
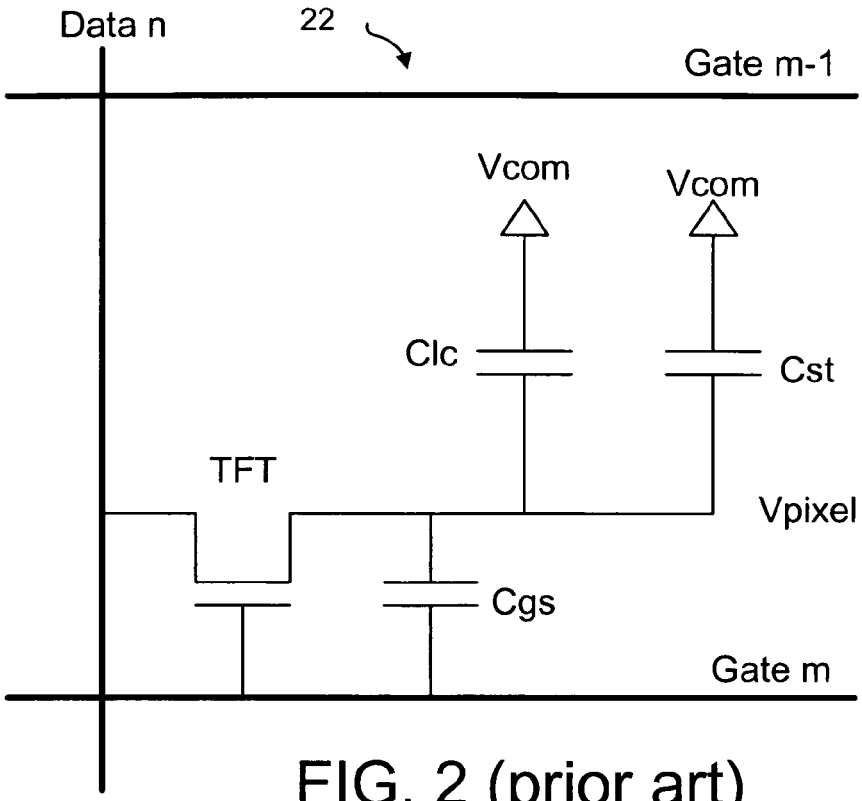
FIG. 2 (prior art)
FIG. 2 illustrates schematically the equivalent capacitive load associated with the LCD pixel and the associated switching element in a prior art LCD display panel.
Figure 3:
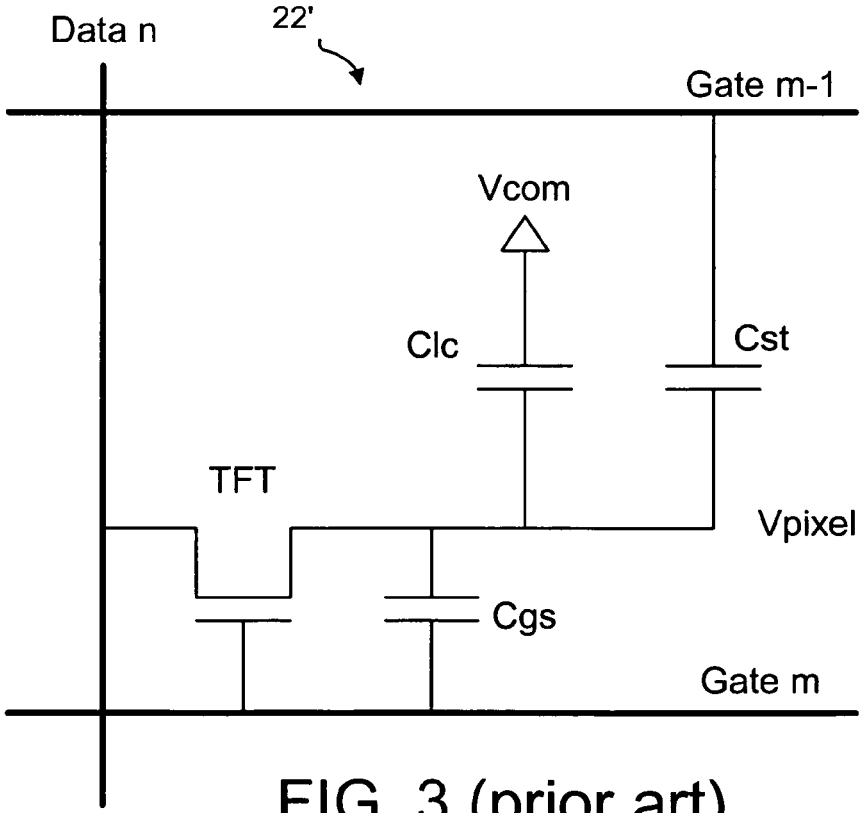
FIG. 3 (prior art)
FIG. 3 illustrates schematically the equivalent capacitive load associated with the LCD pixel and the associated switching element in another prior art LCD display panel.
Figure 4:
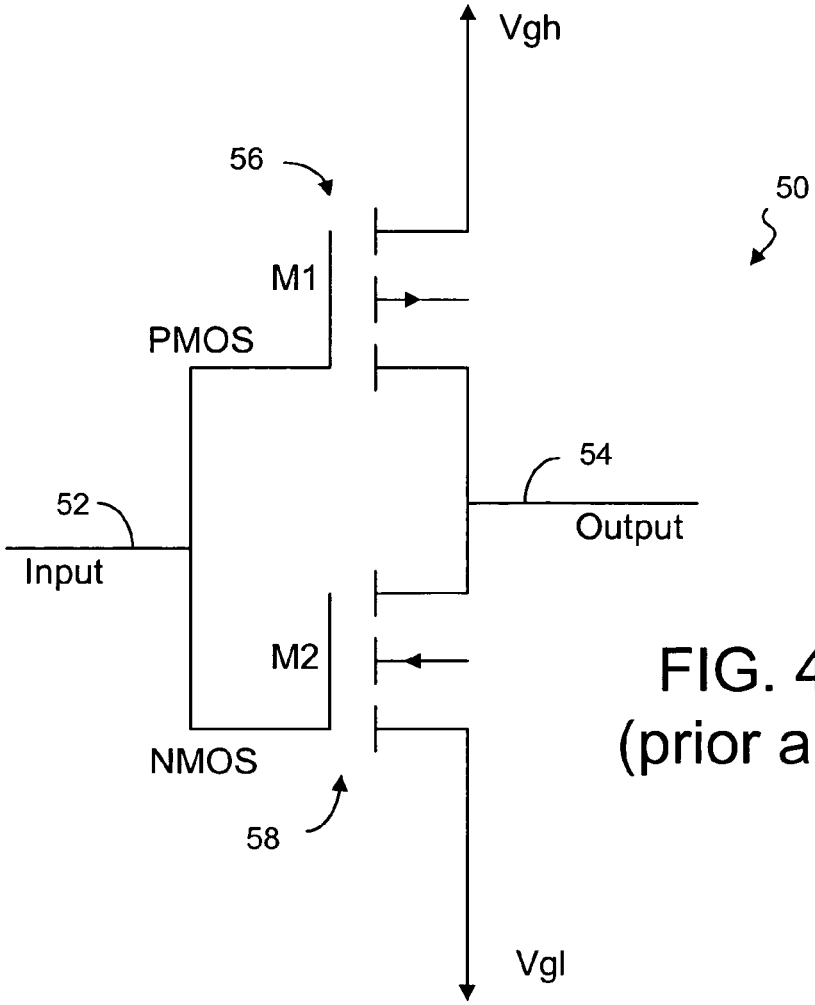
FIG. 4 (prior art)
FIG. 4 shows a typical prior art gate driver circuitry topology.
Figure 5A:
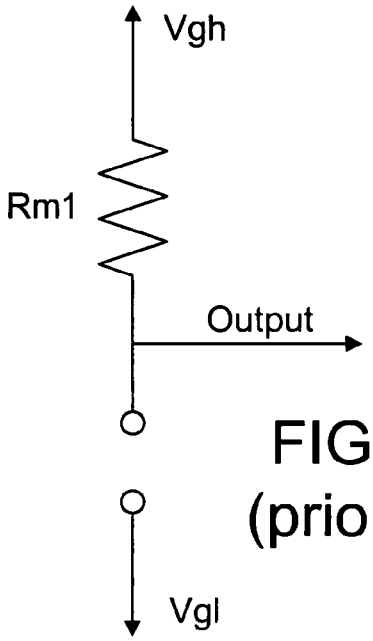
FIG. 5a (prior art)
FIG. 5A shows an equivalent circuit representation of the prior art gate driver of FIG. 4 when the signal at the input is high.
Figure 5B:
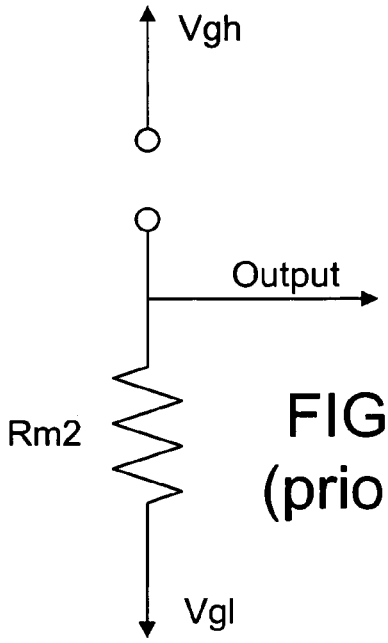
FIG. 5b (prior art)
FIG. 5B shows an equivalent circuit representation of the prior art gate driver of FIG. 4 when the signal at the input is low.
Figure 6:
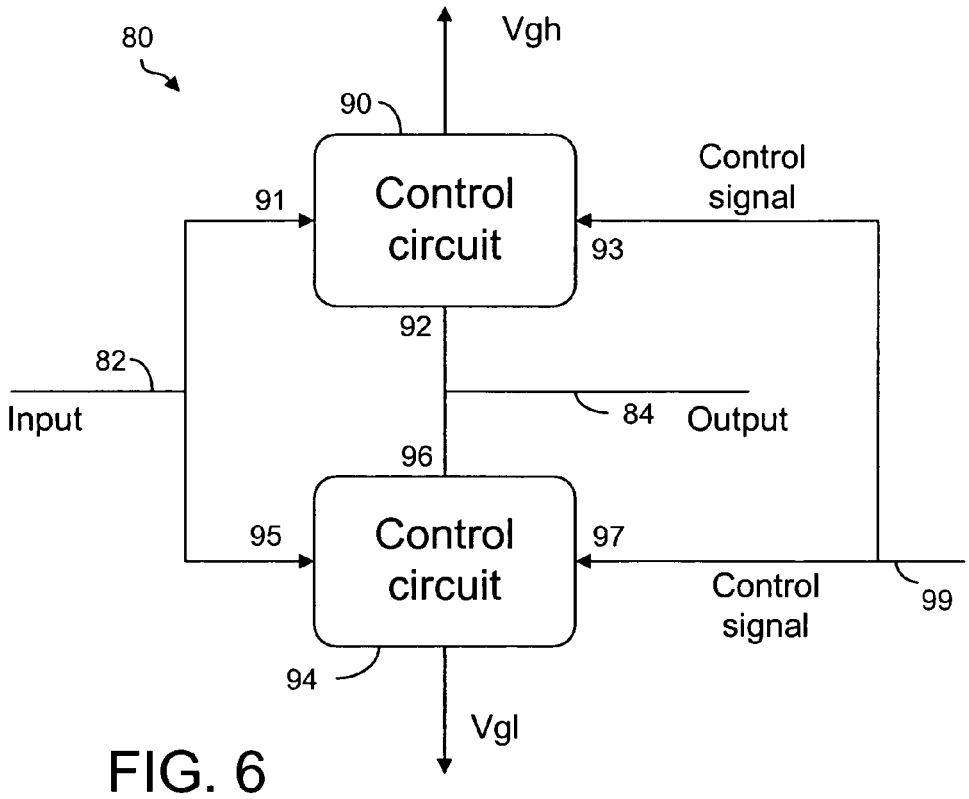
FIG. 6 is a schematic functional circuit representation of the LCD gate driver circuitry of the present invention.

Now considering the drawings with particular reference to FIG. 6, a schematic functional circuit representation of the LCD gate driver circuitry of the present invention is illustrated therein and generally designated 80. The gate driver circuitry 80 includes an input line 82 for receiving a control signal representative of the desired state of a pixel in a row of the display panel and an output line 84 for supplying electrical current to the gate of a switching element connected to the pixel. The gate driver circuitry 80 further comprises a controlled circuit 90 connected to a supply voltage potential Vgh and a controlled circuit 94 connected to a supply voltage potential Vgl. The controlled circuit 90 has an input 91 connected to the input 82 and an output 92 connected to the output line 84. The controlled circuit 94 has an input 95 connected to the input 82 and an output 96 connected to the output line 84. As with the prior art gate driver circuit 50 as shown in FIG. 4, when the signal at the input 82 is high, the signal at the output 92 and the output line 84 is high while the controlled circuit 94 is "OFF". When the signal at the input 82 is low, the signal at the output 96 and the output line 84 is low while the controlled circuit 90 is "OFF". However, the controlled circuit 90 has a control signal input 93 and the controlled circuit 94 has a control signal input 97 to receive a control signal 99 so as to adjust the current driving capacity at the output line 84.

Figure 8A:
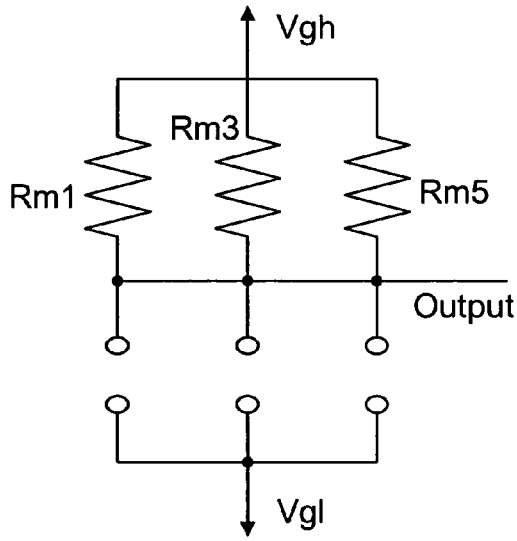
FIG. 8A shows an equivalent circuit representation of the LCD gate driver circuitry of FIGS. 7A and 7B when the signal at the input is high.
Figure 8B:
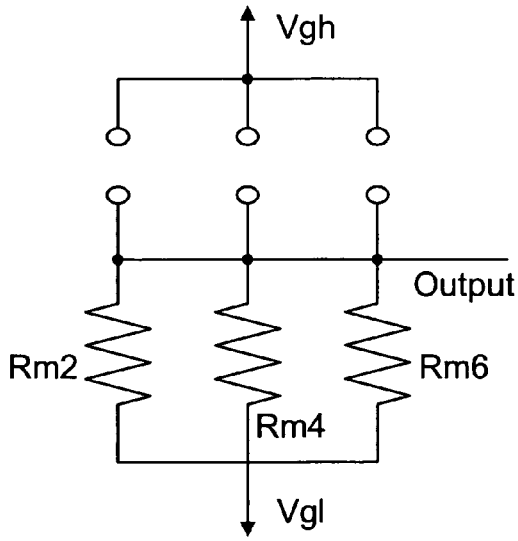
FIG. 8B shows an equivalent circuit representation of the LCD gate driver circuitry of FIGS. 7A and 7B when the signal at the input is low.
Figure 7A:
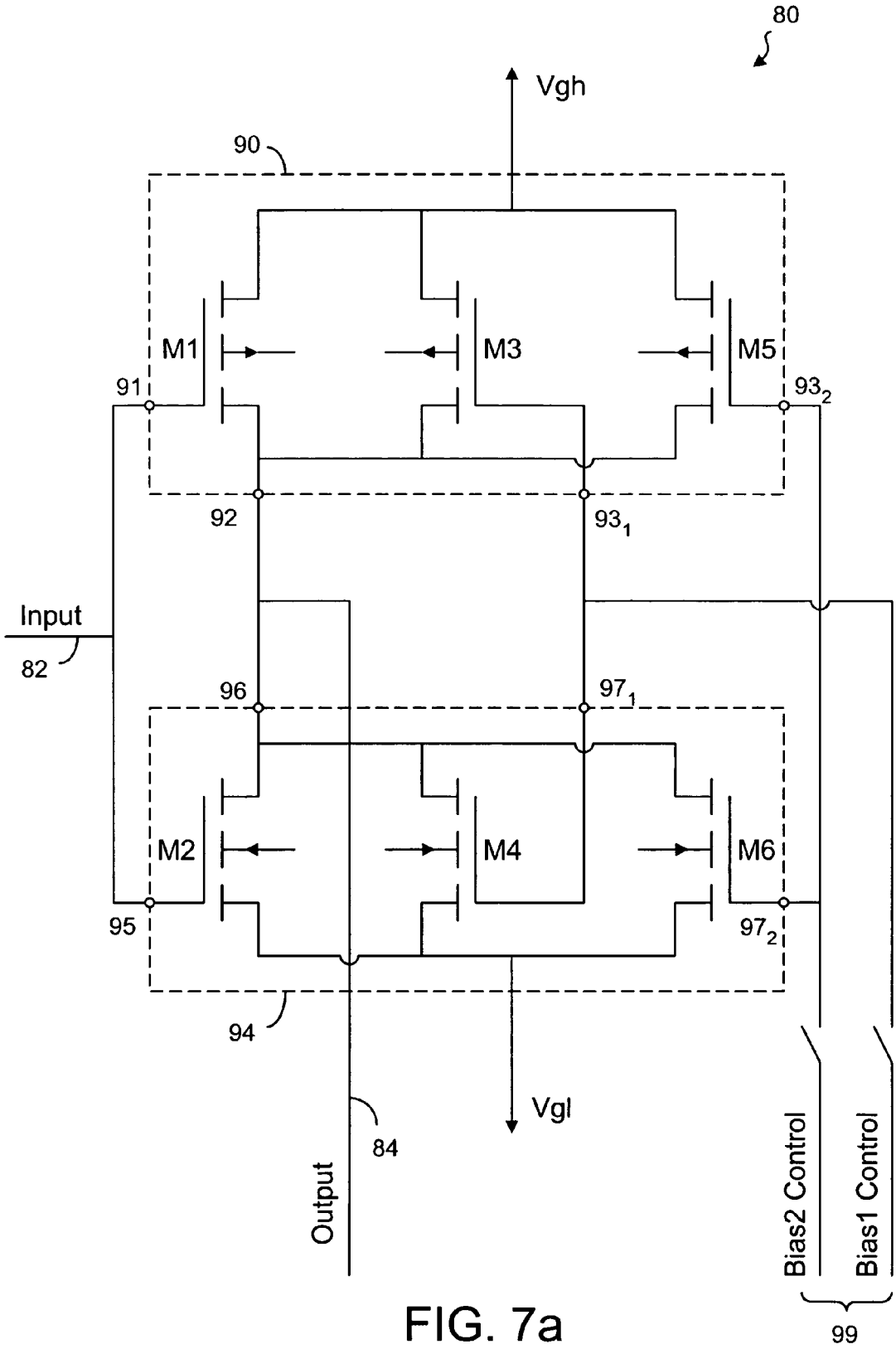
FIGS. 7A and 7B illustrate one implementation of an LCD gate driver circuitry topology embodying the present invention.
Figure 7B:
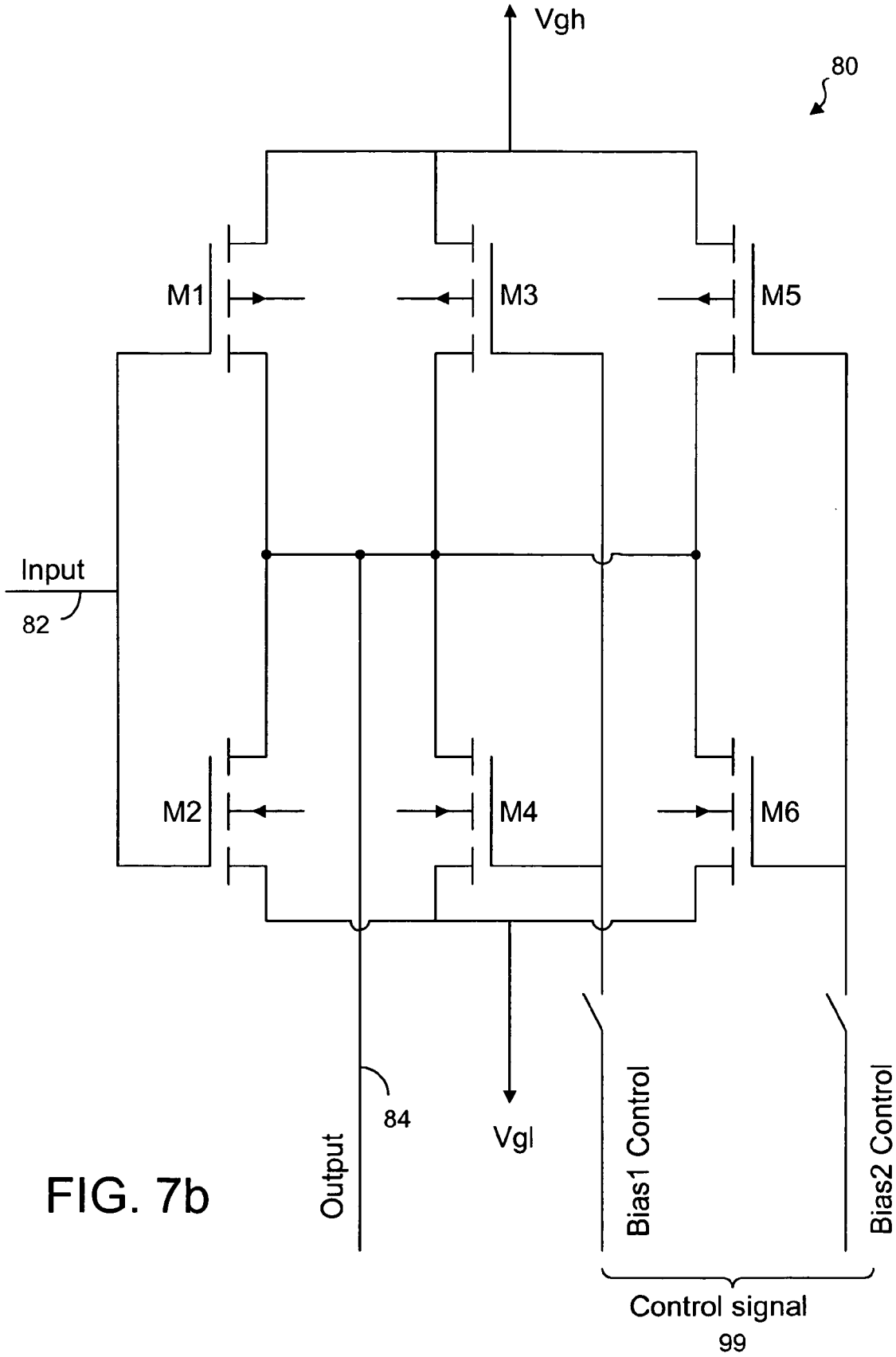

An exemplary gate driver circuitry, according to the present invention is shown in FIG. 7A. In the gate driver circuitry 80 as shown in FIG. 7A, the controlled circuit 90 has a plurality of PMOS switching elements M1, M3, M5 connected in parallel and the controlled circuit 94 has a plurality of NMOS switching elements M2, M4, M6 connected in parallel. The "ON"/"OFF" states of the switching elements M1 and M2 are controlled by the signal at the input 82. The "ON"/"OFF" states of switching elements M3 and M4 are controlled by a signal from BIAS1 where the states of the switching elements M5 and M6 are controlled by a signal from BIAS2. BIAS1 and BIAS2 are part of the control signal 99. Depending on the adjustment range of the driving current capacity, each of the controlled circuits 90, 94 may have two, three or more switching elements connected in parallel. A different representation of the gate driver circuitry 80 is shown in FIG. 7B. As shown, M3 and M4 form a complementary pair of PMOS/NMOS switching elements similar to the switching pair as shown in FIG. 4. M5 and M6 form another complementary pair. Each of the pairs serves as a current booster stage in the gate driver circuitry 80. The equivalent circuit of the gate driver circuitry 80 when the signal at the input 82, and the BIAS1, BIAS2 signals are all high is shown in FIG. 8A. The equivalent circuit of the gate driver circuit 80 when the signal at the input 82 and the BIAS1, BIAS2 signals are low is shown in FIG. 8B. In each of the equivalent circuits, the impedances Rm1, Rm3 and Rm5 are connected in parallel and Rm2, Rm4 and Rm6 are connected in parallel when the signal at the input 82 and the BIAS1, BIAS2 are all high or all low at the same time.

Figure 9:
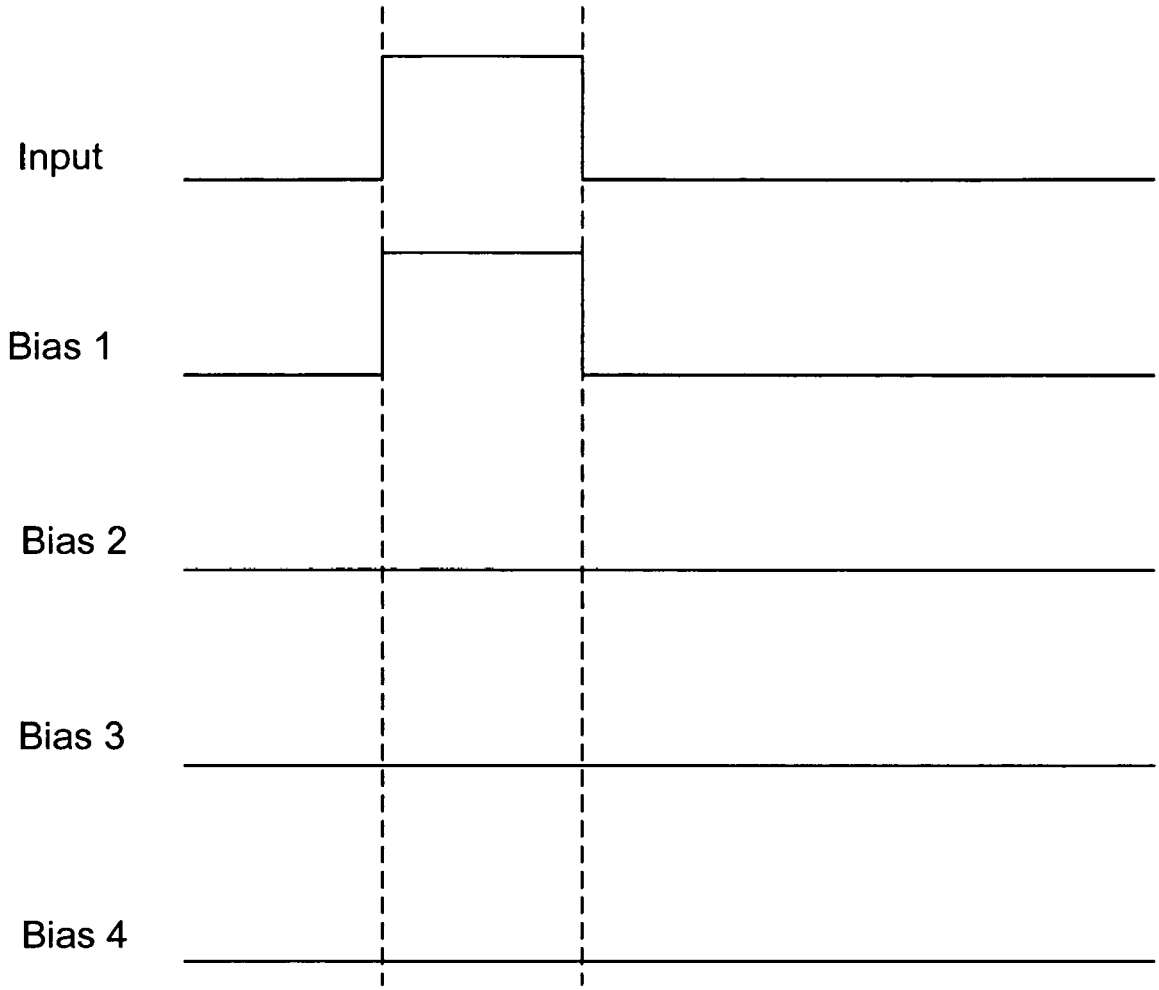
FIG. 9 shows a waveform representation of the input signal to the LCD gate driver circuitry to enable two parallel NMOS, PMOS switching element pairs.

It should be noted that the number of current booster stages added to the switching pair (M1, M2) is two. However, the number of current booster stages can be three or more. Furthermore, the number of added current booster stages that is used is based on the load in the LCD panel. For example, in a gate driver circuit having four added booster stages and four bias lines BIAS1, BIAS2, BIAS3 and BIAS4 are used to adjust the driving current capacity, only one booster stage may be needed to suit the load in the LCD panel. In that case, only one of the four bias lines is turned on, as shown in FIG. 9. If a different LCD panel is used and the load is greater, two booster stages may be needed. In that case, two of the four bias lines are turned on, as shown in FIG. 10.

Figure 10:
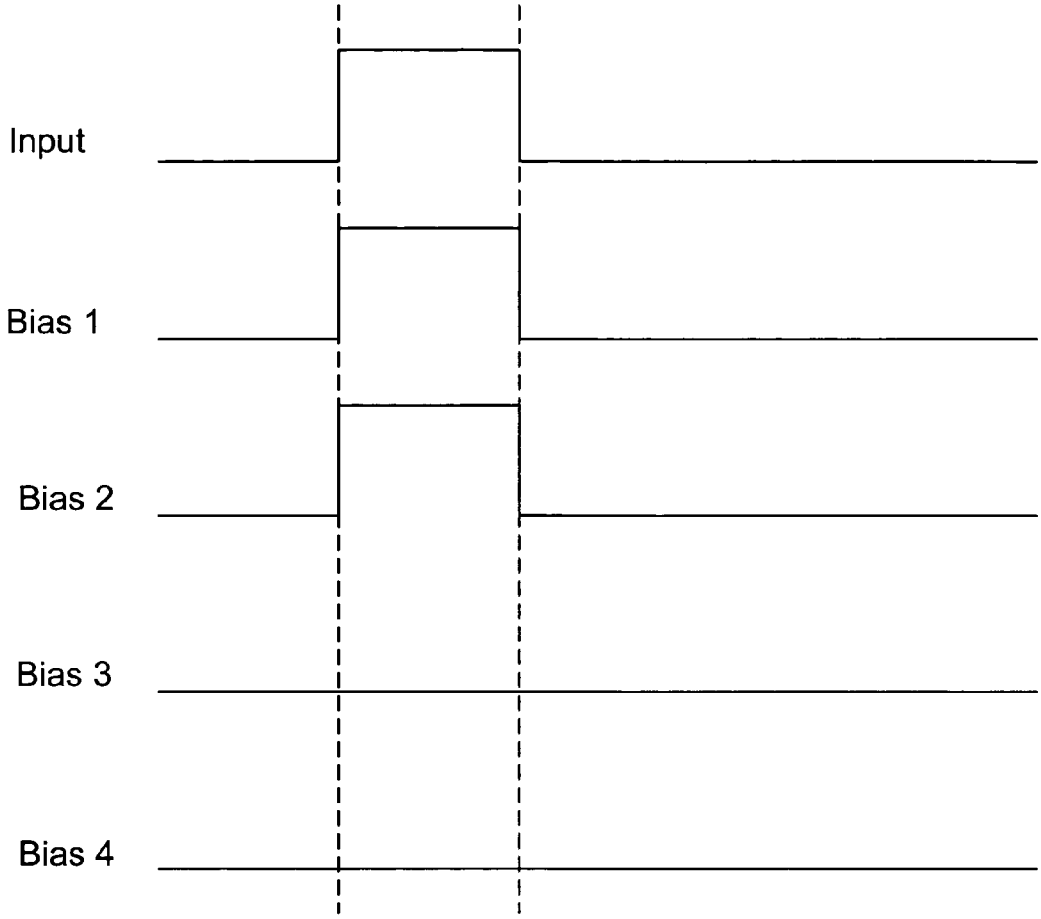
FIG. 10 is a waveform representation of the input signal to enable three parallel NMOS, PMOS switching element pairs.
Figure 12B:
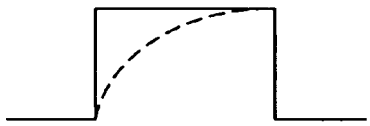
FIG. 12b (prior art)
FIG. 12B shows the capacitor charging waveform of an LCD pixel capacitive load in a prior art LCD display panel.

It should be noted that, in FIGS. 9 and 10, the signals on all the bias lines BIAS1, BIAS2, BIAS3 and BIAS4 has the same time duration or signal width as the input signal.

Figure 11:
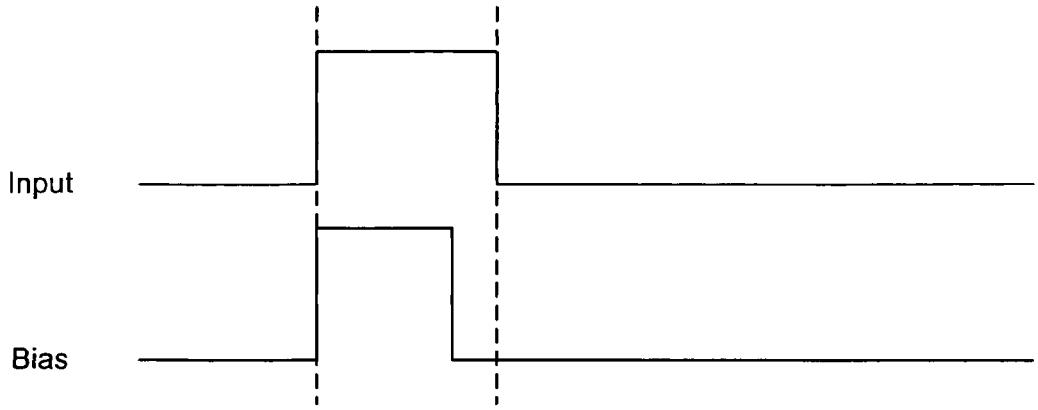
FIG. 11 is a waveform representation of the input signal to enable two or more parallel NMOS, PMOS switching element pairs with selectable signal widths.

Now although the range of the gate driver circuitry embodying the invention as described above is expanded to accommodate different display panels, we can still realize a power savings and charge the pixel capacitor within a certain time by having one or more of the gate drivers stages produce a signal pulse having a pulse signal width selectable by the bias control signal to produce just the right amount of current needed to drive the gate and charge the pixel capacitor. For example, in a gate driver circuitry having K bias lines BIAS1, BIAS2, . . . , BIASK, the signals of the bias lines may have a shorter time duration, as shown in FIG. 11. As such, when the load requires only a short boost, the time duration of the bias signals can be shortened.

Figure 13B:
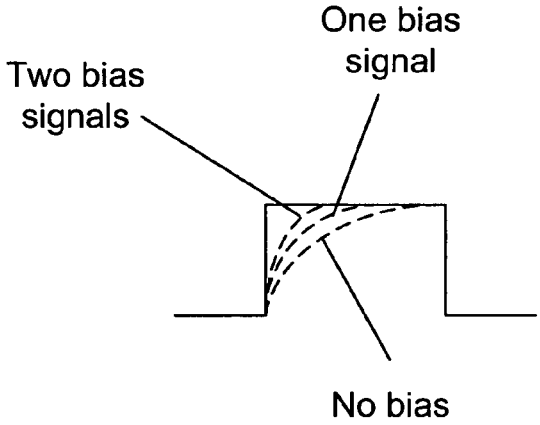
FIG. 13B is a schematic representation of the charging waveform of an LCD pixel capacitive load showing successively shorter charge times as additional driving current is supplied from the gate driver circuitry in accordance with the bias control signal input.
Figure 14A:
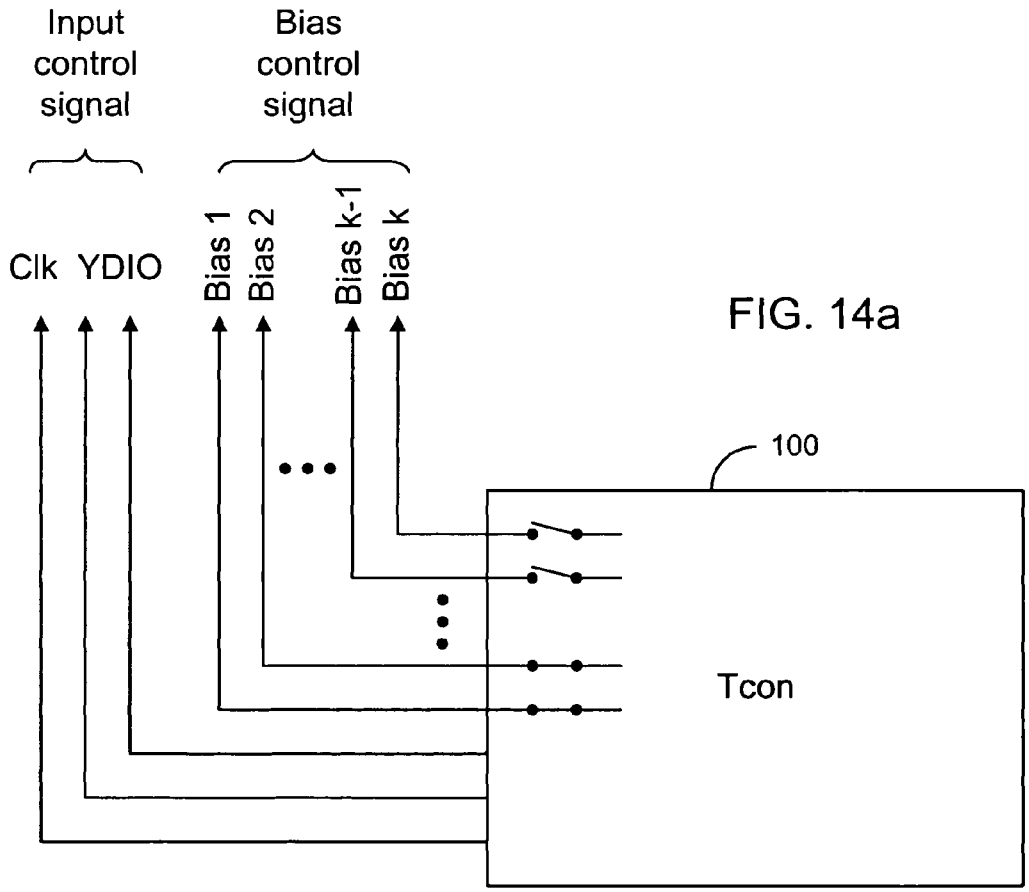
FIG. 14A is a schematic representation showing a method of sending bias control signals to the gate drivers.
Figure 12A:
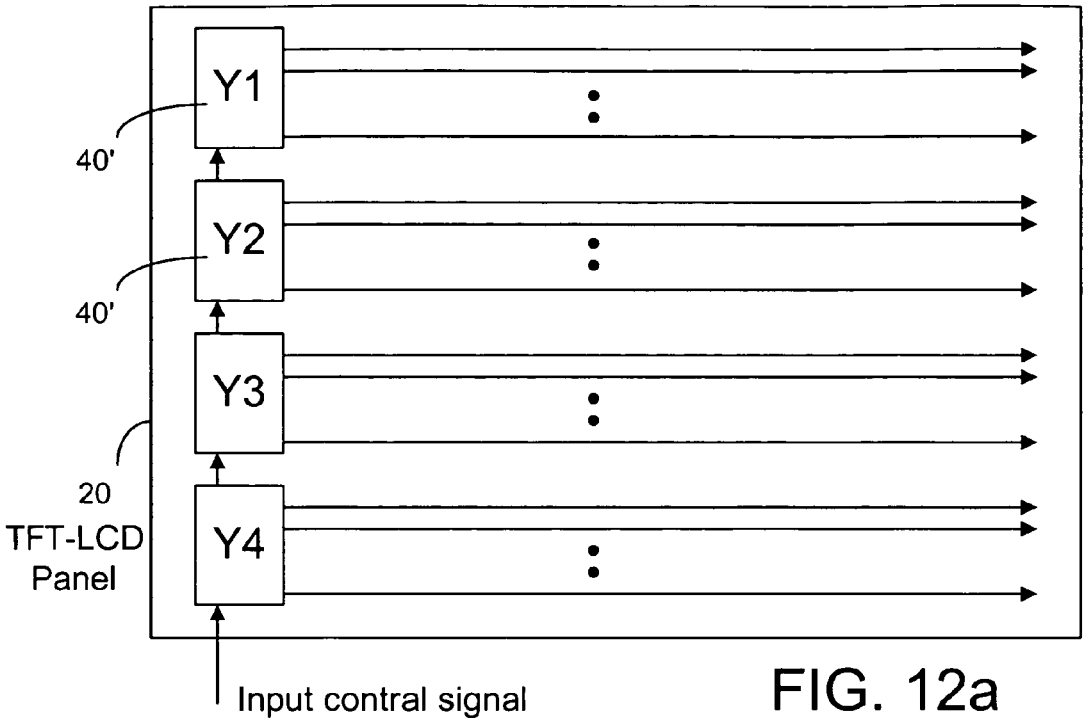
FIG. 12a (prior art)
FIG. 12A illustrates schematically a prior art LCD display panel driven by a fixed duration input control signal.
Figure 13A:
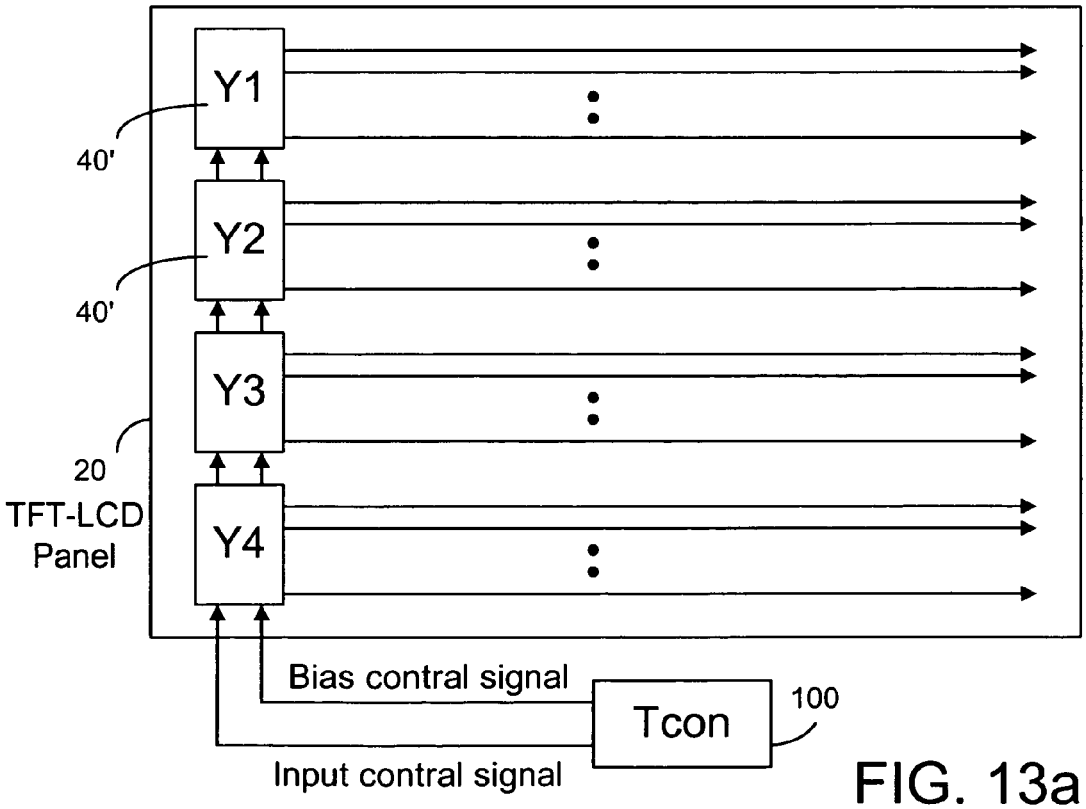
FIG. 13A is a waveform representation of the input signals to a number of parallel NMOS, PMOS switching element pairs wherein the respective NMOS, PMOS switching element pair is enabled for a pre-determined time duration to vary the charging time of the LCD pixel capacitive load in accordance with the display panel used.

Referring to FIGS. 13A and 13B, FIG. 13A shows a TFT-LCD panel 20 having a plurality of gate driver ICs Y1-Y4. Each of the gate driver ICs 40' has a plurality of gate driver circuits to drive a plurality of gate lines. Typically, a gate driver IC has 300-400 channels for driving the same number of gate lines. A control module Tcon 100 is used to provide an input control signal to the gate driver ICs 40' so that the gate lines in the LCD panel are scanned in a sequential manner, for example. Typically, the input control signal includes a clock signal (CLK) and gate driver control signal (YDIO) provided on the signal lines. The control module Tcon 100 also provides a bias control signal to the gate driver ICs to adjust the driving current capacity concurrent to the input signal provided to each gate driver circuitry. The bias control signal having K bias signals BIAS1-BIASK can be provided on K signal lines connected to each of the gate driver ICs, as shown in FIG. 14A. As shown in FIG. 14A, only the signals BIAS1 and BIAS2 are "ON" and all other bias signals are "OFF".

Figure 14B:
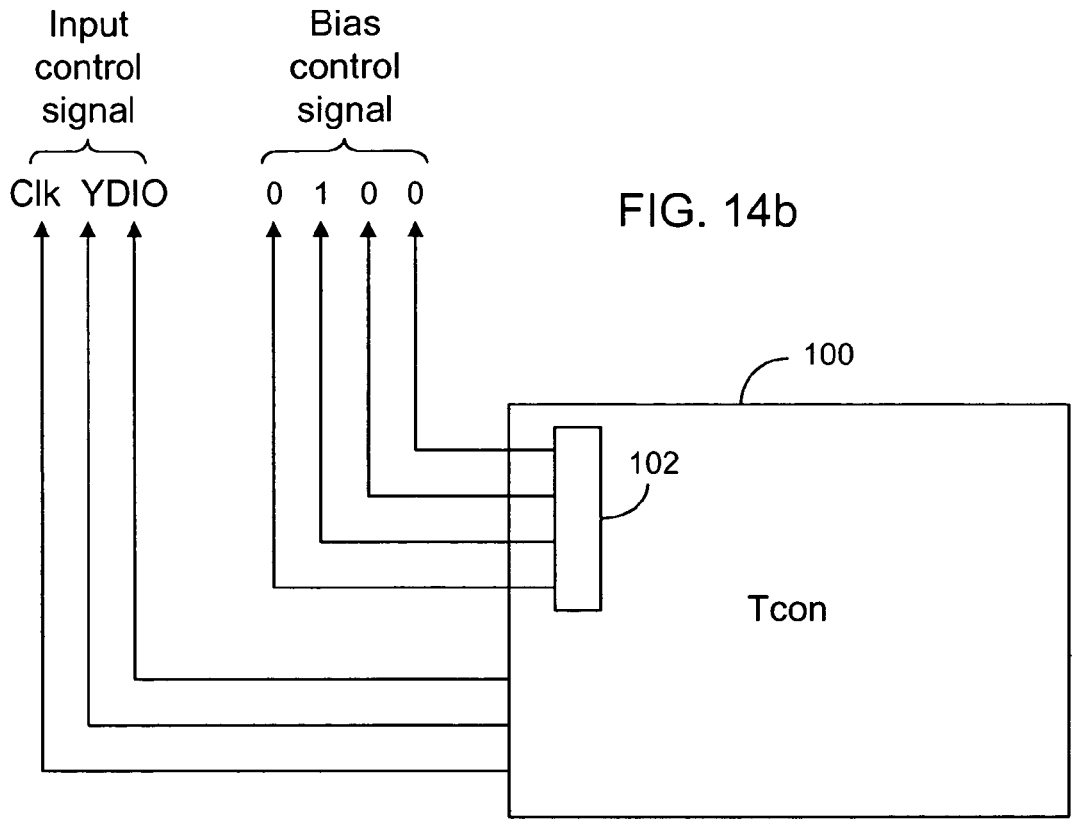
FIG. 14B is a schematic representation showing another method of sending bias control signals to the gate drivers.

Alternatively, the bias control signal is carried out in different states represented by a number of binary digits. For example, no booster stage is turned on at State 1; only BIAS1 is turned on at State 2; and BIAS1 and BIAS2 are turned on at State 3. The state can be represented by a setting in a binary device 102 as shown in FIG. 14B.

Figure 14C:
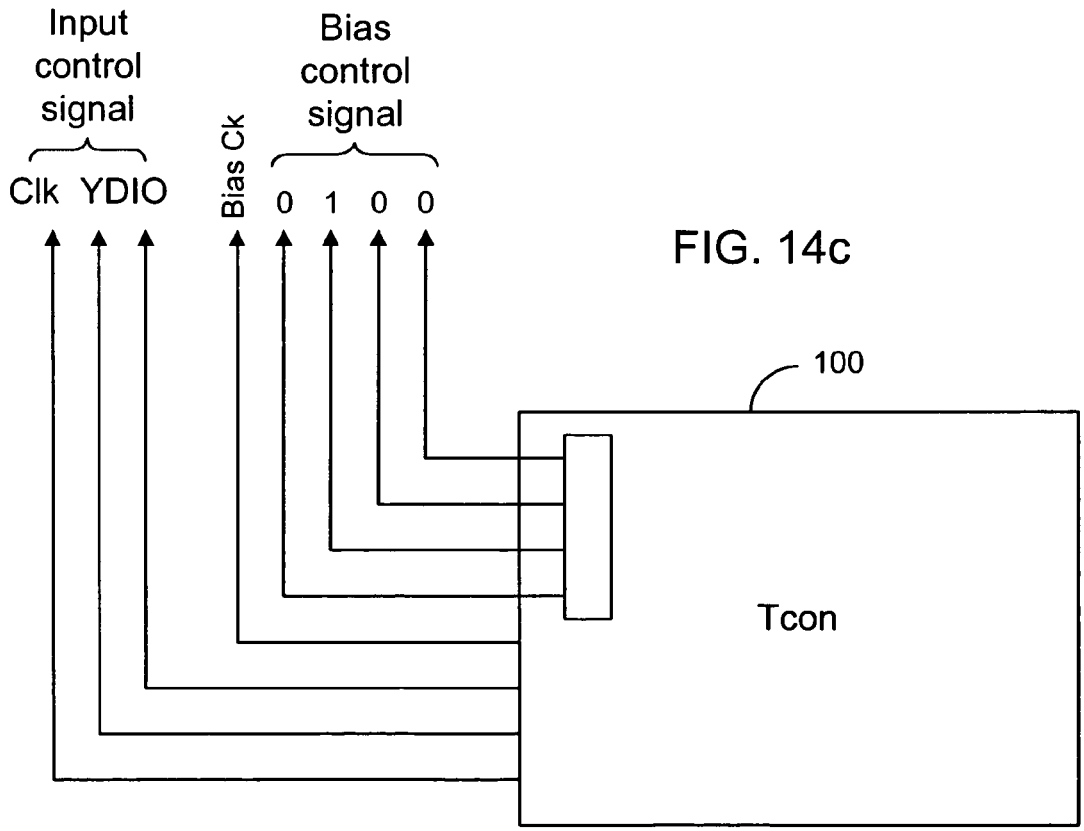
FIG. 14C is a schematic representation showing a different method of sending bias control signals to the gate drivers.

Furthermore, the control module Tcon 100 may be programmed to adjust the pulse width of the bias signal so that the time duration of the current boost can be equal to or shorter than the time duration of the input control signal. It is possible to adjust the time duration of the bias control signal by providing a bias clock signal (Bias CLK) to the gate driver ICs, as shown in FIG. 14C. The bias clock signal is synchronous to the clock signal (CLK) but has shorter pulses.

Thus, although the invention has been described with respect to one or more embodiments thereof, it will be understood by those skilled in the art that the foregoing and various other changes, omissions and deviations in the form and detail thereof may be made without departing from the scope of this invention.

What is claimed is:

1. An LCD gate driver circuitry having an adjustable current driving capacity for use with different display panels, each display panel having a plurality of pixels controllable by a plurality of pixel switching elements, each pixel switching element having a control end connected to a gate line, each pixel associated with a pixel load, said circuitry comprising:

an input line for receiving a control signal representative of a state of pixel in the display panel associated with the gate line;

an output line for supplying electrical current to the gate line;

a first gate driver stage comprising at least one switching element connected to said input line and an output connected to said output line for providing a first signal pulse to said output line in response to the control signal, the first signal pulse arranged to deliver a first current to the gate line, the first signal pulse having a first pulse width; and one or more additional gate driver stages, each of said one or more additional gate driver stages comprising a different switching element connected in parallel with said first gate driver stage, an output connected to said output line, and a different input separated from the input line and arranged to receive a different bias signal separately from the control signal, said different switching element arranged for separately producing a separate second signal pulse in response to the different bias signal, wherein the separate second signal pulse is arranged to deliver a second current at the output, and the separate second signal pulse has an independently adjustable second pulse width, based on the different bias signal, such that the second pulse width is smaller than or equal to the first pulse width, and wherein the current supplied to the gate line is a sum of the first current produced by said first gate driver stage and the second current produced by each of said one or more additional gate driver stages, wherein said at least one switching element comprises a complementary switching element pair having an input end arranged to receive the control signal for producing the first signal pulse in response to the control signal.

2. The LCD gate driver circuitry as defined in claim 1, wherein said different switching element comprises a different complementary switching element pair arranged to receive the different bias signal from said different input for producing the second signal pulse in response to the different bias signal.

3. The LCD gate driver circuitry as defined in claim 1, wherein said one or more additional gate driver stages comprise 1 to N additional complementary switching element pairs, each of the additional complementary switching element pairs arranged to receive one of 1 to N separate bias signals for producing the separate second signal pulse in response to said one of 1 to N separate bias signals.

4. The LCD gate driver circuitry as defined in claim 1, wherein said complementary switching element pair is a PMOS, NMOS switching element pair.

5. The LCD gate driver circuitry as defined in claim 1, wherein each of said one or more additional gate driver stages comprises an independently controlled switch for independently turning on the different bias signal.

6. The LCD gate driver circuitry as defined in claim 1, wherein the gate driver circuit is configured to receive the control signal and the different bias signal from a control module, wherein the control module comprises one or more independently controlled switches, each independent controlled switch configured for independently turning on the different bias signal in each of said one or more additional gate driver stages.

7. The LCD gate driver circuitry as defined in claim 1, wherein the gate driver circuit is configured to receive the control signal and the different bias signal from a control module, wherein the control module comprises one or more bias signal lines, each bias signal line configured for independently turning on the different bias signal in each of said one or more additional gate driver stages.

8. The LCD gate driver circuitry as defined in claim 1, wherein the gate driver circuit is configured to receive the control signal and the different bias signal from a control module, wherein the control module comprises one or more bias signal lines, each bias signal line configured for independently turning on the different bias signal in each of said one or more additional gate driver stages, and wherein the control module is configured to provide a bias clock signal to the gate driver circuitry for adjusting the second pulse width.

9. A method for adjusting a charging time in a display panel having a plurality of pixels controllable by a plurality of pixel switching elements, each pixel switching element having a control end connected to a gate line, each pixel associated with a pixel load, wherein an electrical current is supplied to the control end of the pixel switching element in response to a control signal representative of a state of pixel in the display panel associated with the gate line, said method comprising the steps of:

receiving the control signal via an input line;

producing in a first gate driver stage a first signal pulse in response to the control signal, wherein the first signal pulse is arranged to deliver a first current to the gate line, the first gate driver stage having at least one switching element, the first signal pulse having a first pulse width, the switching element having a first output connected to the gate line;

connecting one or more additional gate driver stages, each of said one or more additional gate driver stages comprising a different switching element connected in parallel with said first gate driver stage, a second output connected to the first output, and a different input separated from the input line; and providing a different bias signal, separately from the control signal, to the different input for causing the different switching element to separately produce a separate second signal pulse having an independently adjustable second pulse width, based on the different bias signal, such that the second pulse width is smaller than or equal to the first pulse width, and wherein the separate second signal pulse is arranged to deliver a second current at the second output such that the current supplied to the gate line is a sum of the first current produced by said first gate driver stage and the second current produced by each of said one or more additional gate driver stages whereby the charging time of the pixel load is adjustable to accommodate a range of pixel load values, wherein said at least one switching element comprises a complementary switching element pair having an input end arranged to receive the control signal for producing the first signal pulse in response to the control signal.

10. The method as defined in claim 9, wherein said different switching element comprises a different complementary switching element pair arranged to receive the different bias signal for producing the separate second signal pulse in response to the different bias signal.

11. The method as defined in claim 9, wherein said one or more additional gate driver stages comprise 1 to N additional complementary switching element pairs, each of the additional complementary switching element pairs arranged to receive one of 1 to N separate bias signals for producing the separate second signal pulse in response to said one of 1 to N separate bias signals.

12. The method as defined in claim 9, wherein said complementary switching element pair is a PMOS, NMOS switching element pair.

13. The method as defined in claim 9, each of said one or more additional gate driver stages comprises an independently controlled switch for independently turning on the different bias signal.

14. The method as defined in claim 9, wherein the different bias signal provided to the different input is independently controlled by a bias signal line from a control module, the control module configured to provide a bias clock signal for adjusting the second pulse width in each of said one or more additional gate driver stages.

15. An LCD gate driver circuitry having an adjustable current driving capacity for use with different display panels, each display panel having a plurality of pixels controllable by a plurality of pixel switching elements, each pixel switching element having a control end connected to a gate line, each pixel associated with a pixel load, said circuitry comprising:

a first complementary switching element pair having a first input terminal for receiving a control signal from an input line, and an output terminal for providing a first signal pulse to the gate line in response to the control signal, the first signal pulse arranged to deliver a first current to the gate line; and one or more second complementary switching element pairs connected in parallel with said first switching element pair, each of said one or more second complementary switching element pairs having a second input terminal separated from the input line for receiving a different bias signal separately from the control signal and an output terminal for providing a second signal pulse to the gate line in response to the different bias signal, the second signal pulse being arranged to deliver a second current to the gate line, wherein the current supplied to the gate line is a sum of the first current produced by said first complementary switching element pair and the second current produced by each of said one or more second complementary switching element pairs.

16. The LCD gate driver circuitry as defined in claim 15, wherein said one or more second complementary switching element pairs comprise 1 to N second complementary switching element pairs each of said 1 to N second complementary switching element pairs having an input end arranged to receive 1 to N separate bias control signals for producing 1 to N second signal pulses in response to said one of 1 to N separate bias control signals, wherein N is a positive integer equal to or greater than 2.

17. The LCD gate driver circuitry as defined in claim 16, wherein said complementary switching element pair is a PMOS, NMOS switching element pair.

18. The LCD gate driver circuitry as defined in claim 15, wherein the first signal pulse has a first pulse width and the second signal pulse has a second pulse width substantially equal to the first pulse width.

19. The LCD gate driver circuitry as defined in claim 15, wherein the first signal pulse has a first pulse width, the second signal pulse has a second pulse width smaller than the first pulse width, and the second pulse width is adjustable based on the control signal.

20. The LCD gate driver circuitry as defined in claim 15, wherein the different bias signal provided to the second input terminal in each of said one or more second complementary switching element pairs is independently controlled by a bias signal line from a control module, the control module configured to provide a bias clock signal for adjusting the second pulse width in each of said one or more second complementary switching element pairs.

* * * * *